US011280140B2

(12) United States Patent
Basler

(10) Patent No.: US 11,280,140 B2
(45) **Date of Patent: *Mar. 22, 2022**

(54) GRIPPER ASSEMBLY FOR CONTINUOUS ROD

(71) Applicant: Weatherford Technology Holdings, LLC, Houston, TX (US)

(72) Inventor: Hermann Basler, Parkland County (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 62 days.

This patent is subject to a terminal disclaimer.

(21) Appl. No.: 16/551,043

(22) Filed: Aug. 26, 2019

(65) Prior Publication Data

US 2020/0003016 A1 Jan. 2, 2020

Related U.S. Application Data

(63) Continuation of application No. 15/281,274, filed on Sep. 30, 2016, now Pat. No. 10,392,875.

(51) Int. Cl.

| | |
|---|---|
| ***E21B 19/06*** | (2006.01) |
| ***E21B 19/08*** | (2006.01) |
| ***E21B 19/22*** | (2006.01) |
| *E21B 43/12* | (2006.01) |

(52) U.S. Cl.

CPC ..... *E21B 19/06* (2013.01); *E21B 19/08* (2013.01); *E21B 19/22* (2013.01); *E21B 43/126* (2013.01)

(58) Field of Classification Search

CPC ..... E21B 19/06; E21B 19/22; E21B 19/08

See application file for complete search history.

(56) References Cited

U.S. PATENT DOCUMENTS

| | | | |
|---|---|---|---|
| 2,679,924 | A | 6/1954 | Powell |
| 3,559,905 | A | 2/1971 | Palynchuk |
| 3,754,474 | A | 8/1973 | Palynchuk |
| 3,778,094 | A | 12/1973 | Grolet et al. |
| 5,094,340 | A | 3/1992 | Avakov |
| 5,188,174 | A | 2/1993 | Anderson, Jr. |
| 5,309,990 | A | 5/1994 | Lance |
| 5,451,084 | A | 9/1995 | Jansch |
| 5,553,668 | A | 9/1996 | Council et al. |
| 5,853,118 | A | 12/1998 | Avakov |
| 5,992,516 | A | 11/1999 | Palynchuk et al. |
| 6,173,769 | B1 | 1/2001 | Goode |

(Continued)

FOREIGN PATENT DOCUMENTS

| | | |
|---|---|---|
| EP | 2470800 B1 | 7/2012 |

OTHER PUBLICATIONS

Eckel Manufacturing Co., Inc. Brochure, Eckel Tong Die Directive, 4 total pages.

(Continued)

*Primary Examiner* — Catherine Loikith

(74) *Attorney, Agent, or Firm* — Patterson + Sheridan, LLP

(57) ABSTRACT

A gripper assembly for handling continuous rod. The gripper assembly may include a gripper face with a gripper profile forming a surface in the gripper face and a texture on a portion of the surface. The texture has a plurality of ridges having a yield strength sufficient to transfer a shear force to the gripper assembly at least as large as a weight of a continuous rod.

20 Claims, 10 Drawing Sheets

(56) References Cited

U.S. PATENT DOCUMENTS

| | | | | |
|---|---|---|---|---|
| 6,189,609 | B1 | 2/2001 | Shaaban et al. | |
| 6,230,955 | B1 | 5/2001 | Parks | |
| 6,332,377 | B1 | 12/2001 | Pietras et al. | |
| 6,378,399 | B1 | 4/2002 | Bangert | |
| 6,484,920 | B1 | 11/2002 | Selcer | |
| 6,580,268 | B2 | 6/2003 | Wolodko | |
| 6,609,566 | B2 | 8/2003 | Perio, Jr. | |
| 6,880,629 | B2 | 4/2005 | Schroeder | |
| 6,892,810 | B2 | 5/2005 | Austbo et al. | |
| 7,140,445 | B2 * | 11/2006 | Shahin | E21B 7/20 166/380 |
| 7,231,984 | B2 | 6/2007 | Jaensch | |
| 7,600,450 | B2 | 10/2009 | Montgomery et al. | |
| 7,857,042 | B2 | 12/2010 | Koopmans et al. | |
| 8,006,752 | B2 | 8/2011 | Basler | |
| 8,132,617 | B2 | 3/2012 | Magnus | |
| 8,869,580 | B2 | 10/2014 | Basler et al. | |
| 9,080,412 | B2 | 7/2015 | Wetzel et al. | |
| 9,371,706 | B2 | 6/2016 | Gubbins et al. | |
| 10,392,875 | B2 * | 8/2019 | Basler | E21B 19/06 |
| 2010/0108323 | A1 | 5/2010 | Wilkin | |
| 2014/0102721 | A1 | 4/2014 | Bespalov et al. | |
| 2014/0251637 | A1 | 9/2014 | Gubbins et al. | |
| 2015/0014462 | A1 | 1/2015 | Basler et al. | |
| 2015/0016915 | A1 | 1/2015 | Basler et al. | |
| 2015/0337636 | A1 | 11/2015 | Gonzales et al. | |
| 2017/0283958 | A1 | 10/2017 | Fraser et al. | |

OTHER PUBLICATIONS

Weatherford Brochure, COROD Continuous Rod Products and Services Substantially Increase Well Run Life in Romania, Document No. 7344.00, 2011, 1 page.

Weatherford Brochure, COROD Continuous Rod and Well Services, 2012-2013, 12 total pages.

Weatherford Brochure, COROD Injectors, Document No. 11282.00, 2014, 2 total pages.

Weatherford Brochure, COROD Continuous Rod, Document No. 12373.00, 2016, 4 total pages.

Australian Office Action in related Australian Patent Application No. 2,980,040 dated Dec. 21, 2020.

CA Office Action for Canadian Application No. 2,980,040 dated Jun. 22, 2021.

* cited by examiner

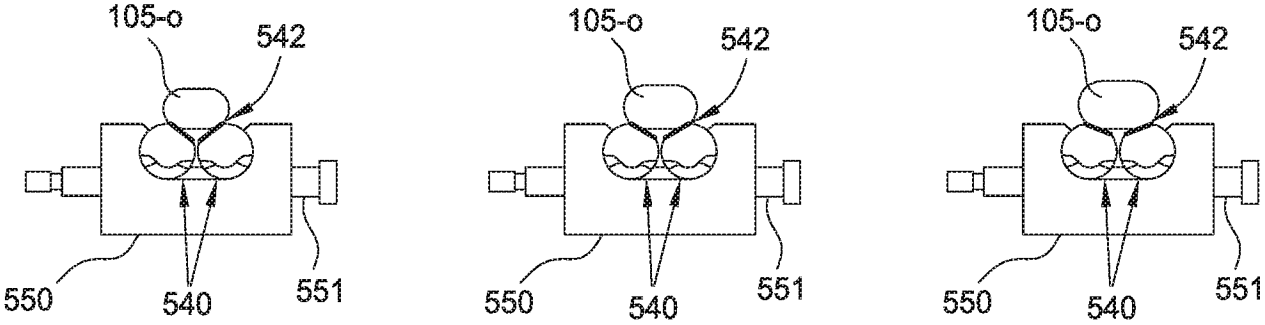
FIG. 9G
FIG. 9H
FIG. 9I
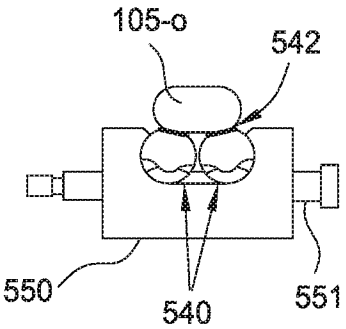
FIG. 9J
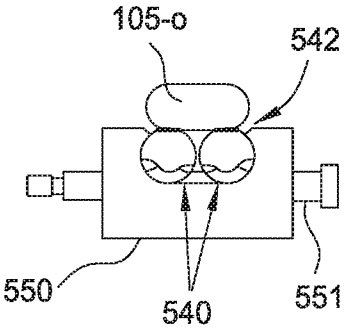
FIG. 9K

GRIPPER ASSEMBLY FOR CONTINUOUS ROD

CROSS-REFERENCE TO RELATED APPLICATIONS

This application is a Continuation of application Ser. No. 15/281,274 filed on Sep. 30, 2016, which is hereby incorporated by reference in its entirety.

BACKGROUND OF THE DISCLOSURE

Field of the Disclosure

Embodiments of the present disclosure generally relate to a gripper assembly for continuous rod and methods of use thereof.

Description of the Related Art

In oil and gas wells, a "rod string" connects a downhole pump to a rod pump located at the surface of the well. For example, an artificial-lift pumping system may use a surface rod pump to drive a downhole pump. A beam and crank assembly of the rod pump may create reciprocating motion in a rod string that connects to the downhole pump. The downhole pump may contain a plunger and valve assembly to convert the reciprocating motion to vertical fluid movement. The rod string may, thereby, support the weight of the downhole pump, linearly moving through the stroke of the rod pump many thousands of times.

A rod string may be a downhole rod assembly including, for example, polished rod, polished rod couplings, continuous rod, shear couplings, and conventional rod (for example, sucker rod). The cross-sectional shape of rod in a rod string may be circular, elliptical, semi-elliptical, or oblong, and the cross-sectional shape and/or diameters may vary throughout the rod string. A conventional rod string typically includes a sequence of sucker rods, having lengths of between about 25 to 30 feet. The ends of each sucker rod may have connecting mechanisms which permit end-to-end interconnection of adjacent sucker rods. Continuous rod may be used in rod strings, in place of or in addition to sucker rods. Replacing sucker rod with continuous rod may avoid weakness caused by interconnection points between sucker rods. A continuous rod may be one elongated continuous piece of steel, having lengths of as little as 500 feet to as much as 10,000 feet or more, depending on the depth of the well and desired location of the downhole pump.

Rod strings in oil and gas wells may be exposed to corrosive conditions, including fluids consisting of varying concentrations of oil, water, hydrogen sulfide, and carbon dioxide, alone or in combination. The presence of chloride ions is also common, which may act to accelerate or enhance the corrosive nature of the other constituents. Additionally, the well fluid carries along sand and silt particles causing wear, which tends to expose bare metal to the corrosive condition of the well fluid. Continuous rod materials, such as carbon or alloyed steel, selected for flexibility during handling and transporting, are not typically corrosion resistant.

It has been suggested to apply one or more coatings to the surface of continuous rod prior to use to protect the continuous rod from corrosion. However, surface coating may create challenges when handling the continuous rod, for example, when injecting into and/or removing from the wellbore. The weight of the downhole rod assembly, including the rod string and the downhole pump, must be supported by the gripper assembly holding the rod string at the surface. Conventional gripper assemblies have typically relied upon friction between gripper pads and the surface of the rod to create the supporting force. However, surface coatings may reduce the coefficient of friction. Application of additional normal force in response to the reduced coefficient of friction may cause damage to the rod (such as surface penetration, crushing, or bending), thereby weakening the rod and/or creating points of corrosion susceptibility. Moreover, conventional gripper pads may erode surface coatings.

Therefore, there is a need for an improved gripper assembly for a rod such as a coated rod.

SUMMARY OF THE DISCLOSURE

Embodiments of the present disclosure generally relate to a gripper assembly for continuous rod and methods of use thereof.

In an embodiment a gripper assembly for handling continuous rod includes: a gripper face having a face width and a face length; a gripper profile forming a surface in the gripper face; and a texture on a portion of the surface, wherein the texture has a plurality of ridges; the ridges have a curvature of between about 0.5 and 1.5; and the texture has a depth of between about 0.010 inch and about 0.020 inch.

In an embodiment, a method of handling a rod string includes engaging a rod of the rod string with a contact surface, the contact surface having a texture; penetrating an exterior layer of the rod with a plurality of ridges of the texture; and supporting at least a portion of a weight of the rod string with a shear force in the exterior layer of the rod.

In an embodiment, a gripper assembly for handling continuous rod includes a gripper face having a face width and a face length; a gripper profile forming a surface in the gripper face; and a plurality of gripper bars, each having a gripper bar profile, wherein the gripper profile is made up of the gripper bar profiles.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 9A-9K illustrate how the gripper bars of an articulating gripper may work in conjunction to passively adapt to a variety of rod shapes and sizes.

DETAILED DESCRIPTION

Figure 1:
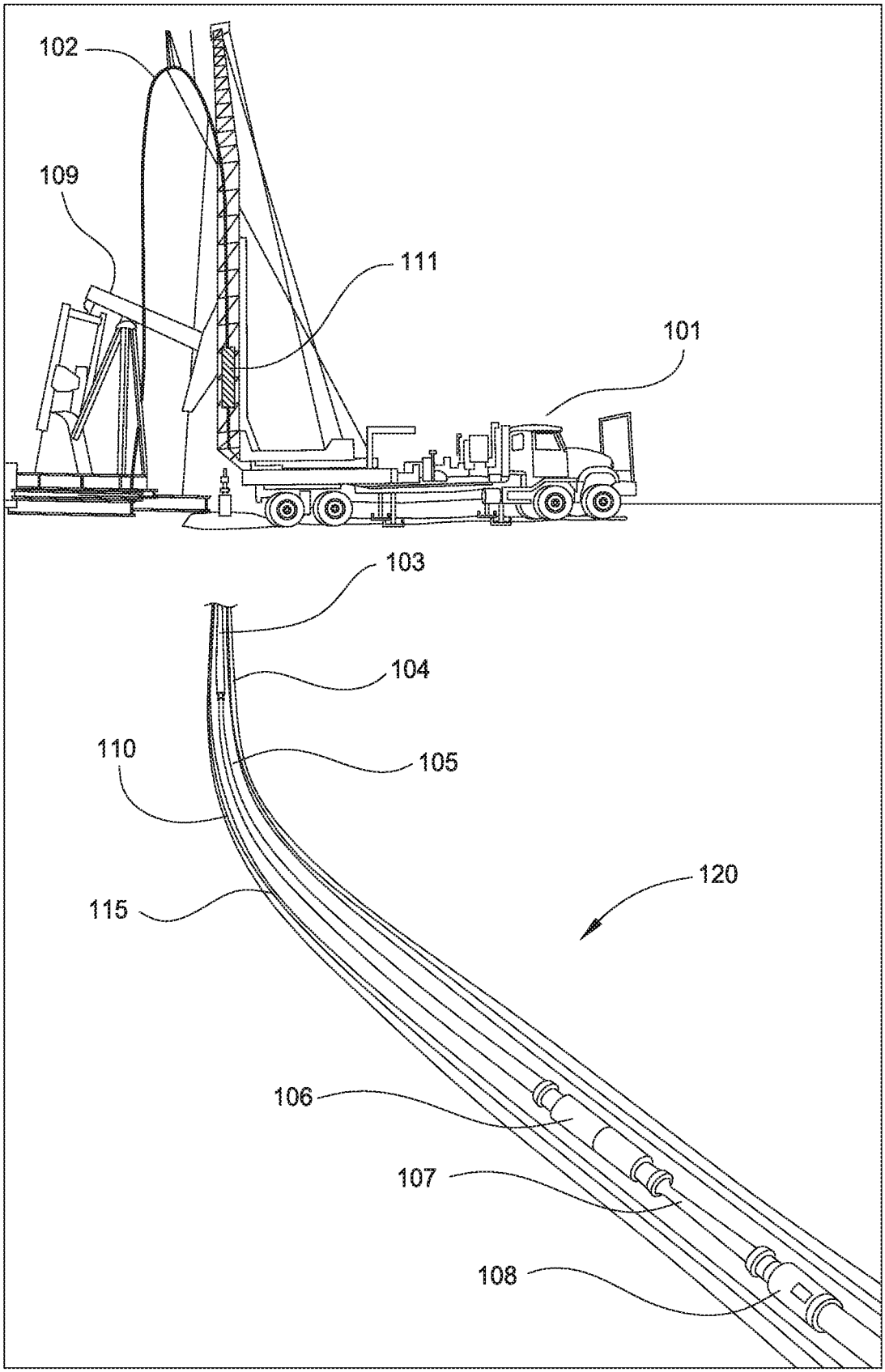
FIG. 1 illustrates an exemplary field operation with continuous rod.

When handling uncoated continuous rod (e.g., bare steel rod), operational conditions may dictate avoiding damage to the rod surface. Soft metal gripper pads may be used to handle uncoated continuous rod. For example, a zinc-aluminum alloy gripper pad may be used. Such soft metal gripper pad material may "flow" when the local surface pressure exceeds the compressive strength of the material. The flowing of the material may allow the soft metal gripper pad to adapt the rod contour, thereby increasing the contact area beyond that of the initial contact. However, as the contact area increases, the surface pressure distributes over a larger contact area. When the surface pressure is distributed to a large enough contact area, the local surface pressure sinks below the compressive strength of the material, the flowing ceases, and a stable contact area/gripper pad contour is achieved. This flowing process may reoccur as the cross-sectional shape of the rod string changes. Depending on the use of the system, the reoccurring flowing process may limit the operational lifetime of the gripper pads.

When handling coated continuous rod, compressive force of the gripper pads may damage the coating. If the supportive force opposing the weight of the rod string is friction only, then the compressive force may exceed the compressive strength of the contacting surfaces, both on the gripper pad and on the rod or the rod coating.

One of the many potential advantages of the embodiments of the present disclosure is that, for a given compressive force, the supportive force may be greater than that from friction only. Another potential advantage includes using gripper contact surfaces with higher strength. Another potential advantage includes using gripper contact surfaces with defined beneficial texture (e.g., wavy contact surface). Another potential advantage includes using improved gripper assemblies with rod that has a softer contact surface, such as would be the case with coated rod. Another potential advantage includes using the shear strength of the coating to supplement frictional force. Another potential advantage includes using lower lateral forces on the contact surfaces, thereby providing more efficient force transmittal, which may be beneficial for the equipment and/or allow the handling of heavier rod strings. Another potential advantage includes using a plurality of articulating gripper bars to achieve an adaptive contact profile (e.g., an articulating gripper profile), which may increase contact surface area and allow further reduction of the compressive force. Another potential advantage includes using a gripper assembly which passively adapts to a variety of rod shapes and sizes (for example, 4 different rod sizes of circular cross-sectional shape, 7 different rod sizes of semi elliptical cross-sectional shape, and tapered rod strings). Embodiments of the present disclosure can thereby be useful in the extraction of hydrocarbons from subsurface formations.

As used herein, the term "coupled" means directly or indirectly connected. The word "exemplary" is used herein to mean "serving as an example, instance, or illustration." Any aspect described herein as "exemplary" is not necessarily to be construed as preferred or advantageous over other aspects. The term "nominal" means as planned or designed in the absence of unplanned phenomena. The terms "coating" and "layer" may be understood to mean a surface covering that may or may not fully cover the surface. Planned or unplanned gaps may exist in the covering, and the thickness may vary across the surface.

FIG. 1 illustrates an exemplary field operation with continuous rod. As illustrated, a spool 102 of continuous rod 105, such as COROD® Continuous Rod, available from Weatherford, is delivered to a well site using a transportation and servicing system 101, such as a Corig™ Unit, available from Weatherford. The continuous rod 105 is injected into a tubing 115 disposed in wellbore 110. The continuous rod 105 thereby makes up a portion of a rod string 120. In various operations, rod string 120 may include several different types of equipment, such as polished rod 103, polished rod coupling 104, continuous rod 105, shear coupling 106, and conventional rod 107. During pumping operations, the rod string 120 connects downhole pump 108 to rod pump 109, located at the surface. Continuous rod 105 is transferred between spool 102 and tubing 115 by the action of rod injector 111. Transferring continuous rod 105 into tubing 115 may be referred to as "injecting" or "tripping-in", and transferring continuous rod 105 out of tubing 115 may be referred to as "removing" or "tripping-out."

Figure 2:
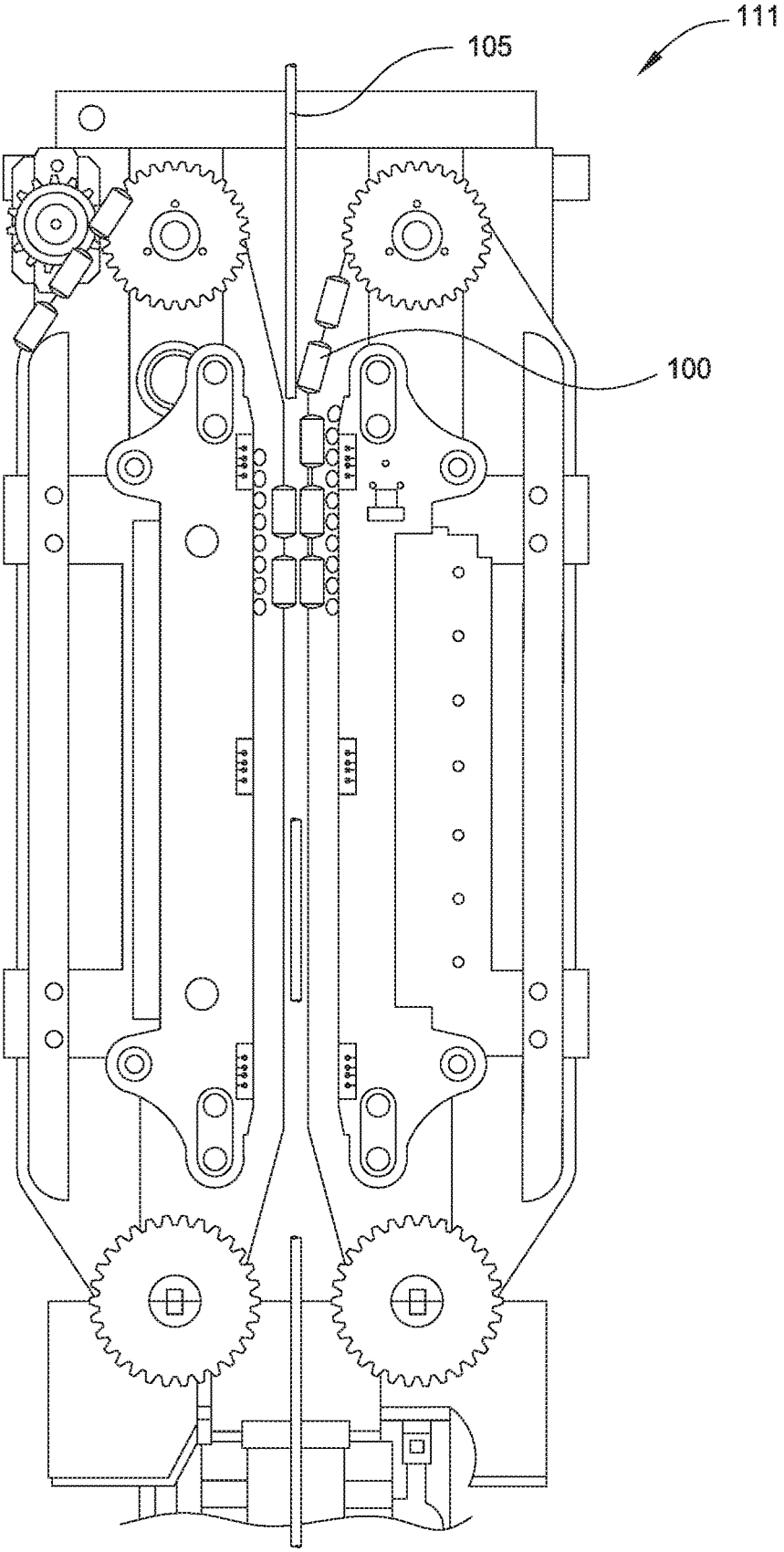
FIG. 2 illustrates an exemplary rod injector.

FIG. 2 illustrates an exemplary rod injector 111. In some operations, rod injector 111 may be capable of tripping continuous rod 105 at rates of up to 100 feet/minute. Rod injector 111 engages continuous rod 105 with gripper assembly 100, thereby supporting the weight of the downhole rod assembly, including the rod string 120 and the downhole pump 108. Typical rod strings may weigh between about 2000 lb and about 25,000 lb, and may be between about 500 feet and about 10,000 feet in length. In a single rod string 120, continuous rod 105 may have multiple cross-sectional shapes (e.g., circular, elliptical, semi-elliptical, or oblong) and/or multiple diameters (e.g., tapered rod). For example, Table 1 lists standard dimensions for COROD® Continuous Rod. Continuous rod 105 may have one or more layers of coating (those closer to the rod referred to as "interior," and those farther from the rod referred to as "exterior"). Embodiments disclosed herein allow rod injector 111 to handle each of the expected continuous rod dimensions without user intervention to switch or modify gripper assembly 100. Embodiments disclosed herein allow rod injector 111 to handle both coated and uncoated continuous rod, while reducing or eliminating surface damage to the continuous rod and/or interior coating layer(s).

TABLE 1

| COROD ® | Nominal Size | | Weight | | Area (min.) | | Major Diameter | | Minor Diameter | |
|---|---|---|---|---|---|---|---|---|---|---|
| | | | | | | | in. | mm | in. | mm |
| No. | in. | mm | lb/ft | kg/m | in.$^2$ | mm$^2$ | (±0.020) | (±0.5) | (±0.020) | (±0.5) |
| 8 | 1⅛ | 28.6 | 3.38 | 5.03 | 0.994 | 641.3 | 1.570 | 39.9 | 0.745 | 18.9 |
| 7 | 1 1/16 | 27.0 | 3.01 | 4.49 | 0.887 | 572.0 | 1.430 | 36.3 | 0.745 | 18.9 |
| 6 | 1 | 25.4 | 2.67 | 3.98 | 0.785 | 506.7 | 1.260 | 32.0 | 0.740 | 18.8 |
| 5 | 15/16 | 23.8 | 2.35 | 3.50 | 0.690 | 445.3 | 1.115 | 28.3 | 0.730 | 18.5 |
| 4 | ⅞ | 22.2 | 2.04 | 3.05 | 0.601 | 387.9 | 1.005 | 25.5 | 0.700 | 17.8 |
| 3 | 13/16 | 20.6 | 1.76 | 2.63 | 0.518 | 334.5 | 0.940 | 23.9 | 0.650 | 16.5 |

TABLE 1-continued

| COROD ® | Nominal Size | | Weight | | Area (min.) | | Major Diameter | | Minor Diameter | |
|---|---|---|---|---|---|---|---|---|---|---|
| | | | | | | | in. | mm | in. | mm |
| No. | in. | mm | lb/ft | kg/m | in.$^2$ | mm$^2$ | (±0.020) | (±0.5) | (±0.020) | (±0.5) |
| 2 | 3/4 | 19.1 | 1.50 | 2.24 | 0.442 | 285.0 | 0.870 | 22.1 | 0.600 | 15.2 |
| 8.5R | 1 5/32 | 29.4 | 3.57 | 5.32 | 1.050 | 677.4 | 1.156 | 29.4 | N/A | N/A |
| 6R | 1 | 25.4 | 2.67 | 3.98 | 0.785 | 506.7 | 1.000 | 25.4 | N/A | N/A |
| 4R | 7/8 | 22.2 | 2.04 | 3.05 | 0.601 | 387.9 | 0.875 | 22.2 | N/A | N/A |
| 3R | 13/16 | 20.6 | 1.76 | 2.63 | 0.518 | 334.5 | 0.812 | 20.6 | N/A | N/A |

Figure 3:
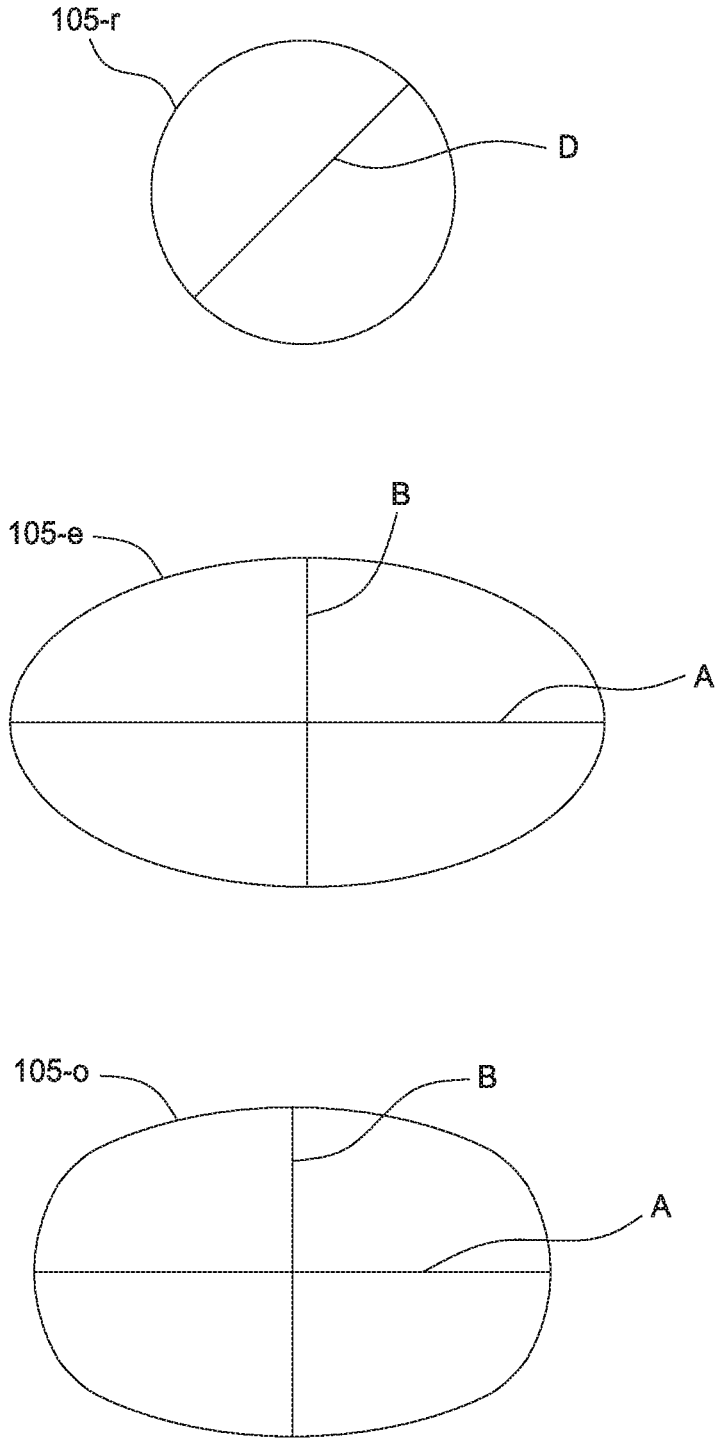
FIG. 3 illustrates different cross-sectional shapes of continuous rod.

FIG. 3 illustrates different cross-sectional shapes of continuous rod 105. Continuous rod 105-*r* has a circular cross-sectional shape, having a diameter D. Continuous rod with circular cross-sectional shape may be referred to as "round rod." In Table 1, COROD® Nos. 8.5R, 6R, 4R, and 3R provide dimensions of round rod. Continuous rod 105-*e* has an elliptical cross-sectional shape, and continuous rod 105-*o* has a semi-elliptical/oblong cross-sectional shape. Continuous rod 105-*e* and continuous rod 105-*o* each has a major diameter A and a minor diameter B. Continuous rod with elliptical or oblong cross-sectional shape may be referred to as "elliptical rod." In Table 1, COROD® Nos. 8, 7, 6, 5, 4, 3, and 2 provide dimensions of elliptical rod.

Continuous rod 105 may be coated with one or more protective coatings. Such coatings may be formed from thermosetting polymers, such as fusion bond epoxies. In one embodiment, the one or more protective coatings include an interior layer and an exterior layer. The interior layer may be selected from coatings having good adhesion to the base material of the continuous rod 105, thus providing a high level of protection to fluid ingress. The interior layer may function to provide corrosion inhibition and corrosion protection to the rod. The interior coating may be a fusion bond epoxy layer having a thickness between about 0.002 inches to about 0.040 inches. In one embodiment, the interior coating may include a primer directly applied to the rod and a fusion bond epoxy powder applied over the primer. The exterior layer may be selected from coating materials capable of providing protection for the interior layer against damages sustained during service and operation. The exterior coating may be fusion bond epoxy layer having a thickness between about 0.010 inches to about 0.060 inches. In one embodiment, the exterior coating may be a friction and abrasion reduction layer. The exterior coating may reduce friction with other material and/or may reduce wear/abrasion caused by well fluids and its contaminants, thus providing protection to the interior coating. Taken together, the coating layers may increase the diameter of the continuous rod 105 by as much as 0.200 inches.

The exterior coating may serve as protection for the interior coating. Due to the low friction coefficient of the coating material to the adjacent lubricated metal, the exterior coating may also act as a mechanical interface to the continuous rod 105 for the mechanical handling (e.g., engagement with a gripper assembly 100) of the rod string. In one embodiment, during the mechanical handling, the exterior coating may be permanently deformed in a planned manner and engaged with shear strength of the coating material to transmit the supportive forces along a limited length of continuous rod 105. To provide protection and mechanical strength, the thickness of the exterior coating may be larger than the thickness of the interior coating. In one embodiment, the exterior coating is between about 3 times to about 30 times in thickness of the interior coating.

Figure 4:
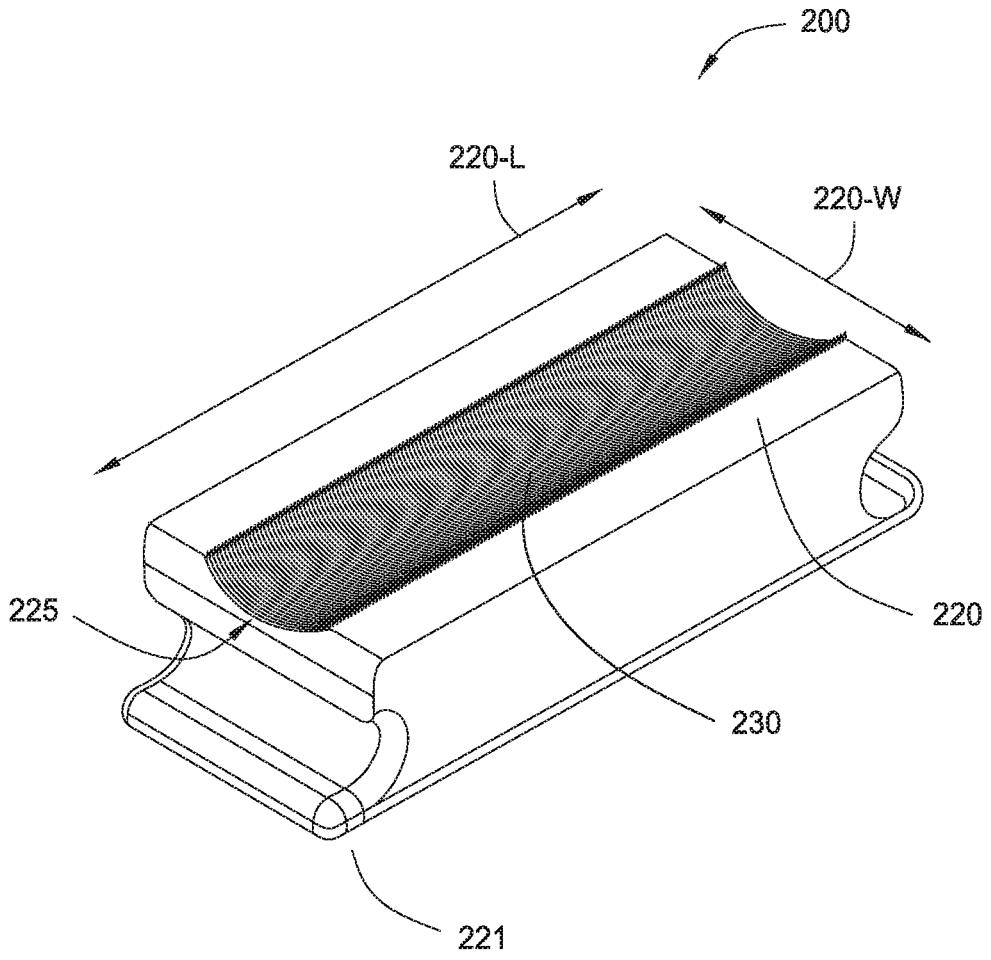
FIG. 4 illustrates a gripper rod assembly having a gripper pad.

In some embodiments, gripper assembly 100 may engage continuous rod 105 with a gripper pad 200, as illustrated in FIG. 4. Gripper pad 200 has a face 220, which is a planar surface having a length 220-L and a width 220-W. Gripper profile 225 is a concave surface formed (e.g., ground, cut, machined, molded, or 3D printed) in the face 220 of gripper pad 200. As illustrated, gripper profile 225 is a cylindrical arc, having a chord parallel to gripper face 220 and in the direction of gripper face width 220-W. The surface of gripper profile 225 has a texture 230. Gripper pad 200 may attach to gripper assembly 100 with coupling 221. In some embodiments, the face length 220-L may be between about 2 inches and about 4 inches. In some embodiments, the face width 220-W may be between about 1 inch and about 2 inches.

Figure 5:
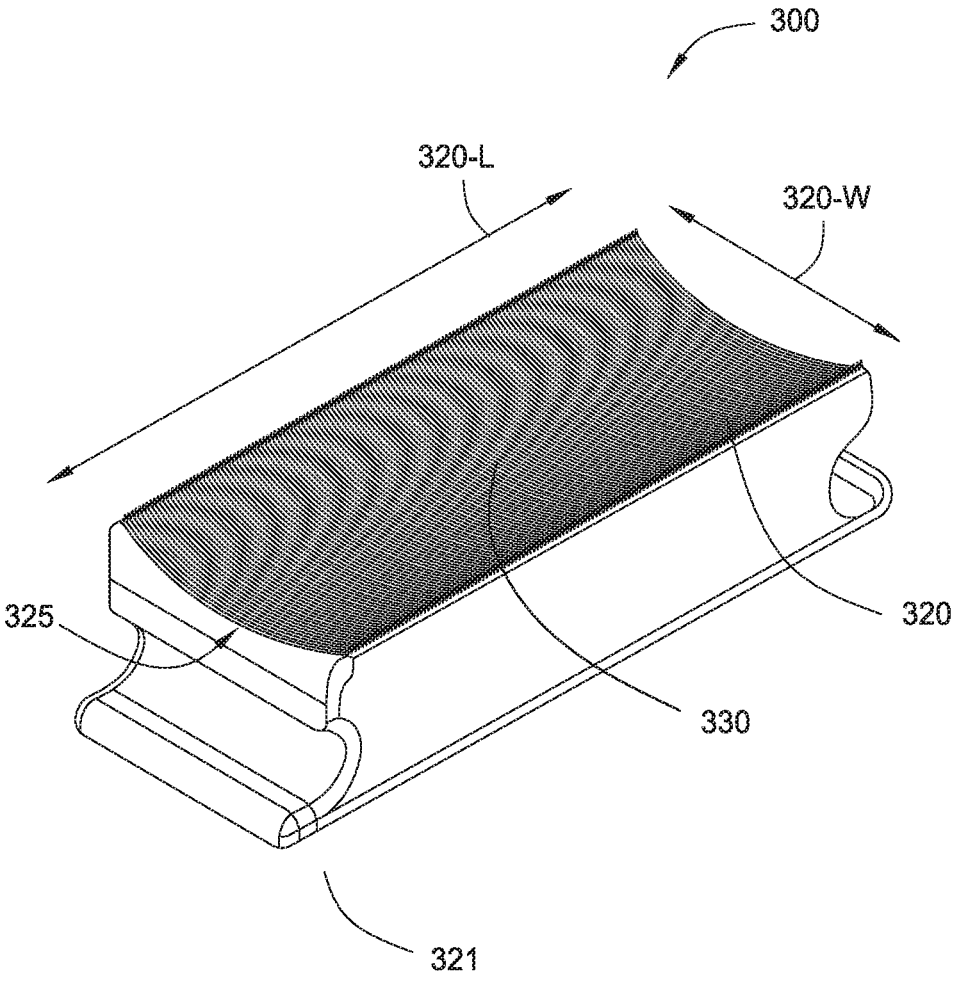
FIG. 5 illustrates another gripper rod assembly having a gripper pad.

In some embodiments, gripper assembly 100 may engage continuous rod 105 with a gripper pad 300, as illustrated in FIG. 5. Gripper pad 300 has a face 320, which is a planar surface having a length 320-L and a width 320-W. Gripper profile 325 is a concave surface formed (e.g., ground, cut, machined, molded, or 3D printed) in the face 320 of gripper pad 300. As illustrated, gripper profile 325 is an elliptical-cylinder arc, having an elliptical chord parallel to gripper face 320 and in the direction of gripper face width 320-W. The surface of gripper profile 325 has a texture 330. Gripper pad 300 may attach to gripper assembly 100 using coupling 321. In some embodiments, the face length 320-L may be between about 1 inch and about 10 inches, such as about 2 inches and about 4 inches. In some embodiments, the face width 320-W may be between about 1 inch and about 5 inches, such as between about 1 inch and about 2 inches.

Gripper pads 200 and 300 may be configured to engage coated or uncoated continuous rod 105 so that both shear force and friction force contribute to supporting the weight of rod string 120. In some embodiments, gripper pad 200/300 may be made from materials with high compressive strength, such as machinable or castable steel or high strength cast iron. In some embodiments, texture 230 of gripper pad 200, and/or texture 330 of gripper pad 300, may be selected to advantageously engage continuous rod 105. For example, the texture 230/330 may be made up of a collection of ridges and grooves, and the depth of the texture 230/330—the height of a ridge measured from the bottom of a groove—may be selected so that only an exterior layer of the rod (or coating thereon) is penetrated by the ridges of the texture 230/330. By engaging the exterior layer of the (coated or uncoated) continuous rod, the ridges and grooves may deform the exterior layer, temporarily or permanently. The ridges may be selected to be sufficiently wide to resist breakage or deformation when gripper pad 200/300 engages continuous rod 105. The grooves of the texture 230/330 may be selected to be sufficiently wide to allow the surface of continuous rod 105 (or any coating thereon) to provide shear force in response to penetration by the ridges and in opposition to the weight of the rod string. The curvature of the ridges of the texture 230/330 may be selected to be sufficiently round and/or smooth to reduce or avoid the risk of damaging, notching, puncturing and/or deforming continuous rod 105 (or any coating thereon). The pattern of the texture 230/330 may be selected to be easy to form (e.g., grind, cut, machine, mold, or 3D print) in gripper pad 200/300. The pattern of texture 230/330 may be random or repeating. For example, a random pattern may be an undulating surface texture. In some embodiments, conventional gripper pads may be machined to create a gripper profile 225/325 with a texture 230/330. The material of the gripper pad 200/300 and the shape of the texture 230/330 may be selected produce a yield strength in the ridges sufficient to transfer the shear force to the gripper assembly 100 to support the weight of the rod string. In some embodiments, the yield strength may be between about 60 kilopound per square inch and about 85 kilopound per square inch. In some embodiments, the yield strength may be at least about the shear strength of the exterior coating. In some embodiments, the yield strength may be no more than about the final yield strength of the lowest grade COROD®.

Figure 6A:
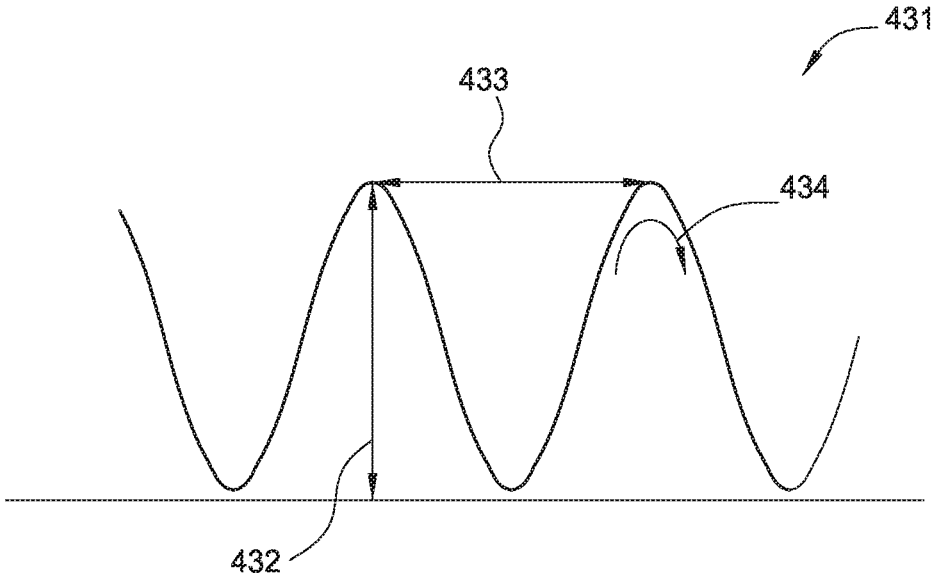
FIGS. 6A-6C illustrate gripper profile textures.

In some embodiments, the texture 230/330 may be a wavy pattern. For example, as illustrated in FIGS. 4, 5, and 6A, the texture 230/330 may be a series of sine waves 431 along the length 220-L/320-L of gripper pad 200/300. The depth 432 of the texture 230/330 is twice the amplitude of the sine wave 431. In some embodiments, the depth 432 may be between about 0.005 inch and about 0.040 inch, such as between about 0.010 inch and about 0.020 inch. The ridges are separated by the distance of the wavelength 433. In some embodiments, the wavelength 433 may be between about 0.060 inch and about 0.500 inch, for example, between about 0.010 inch and about 0.020 inch. In some embodiments, the wavelength 433 may be between about 1% and about 10% of the length 220-L/320-L. The curvature 434 of each ridge is $$\frac{\text{depth}}{2 \times \text{wavelength}}.$$

Figure 6B:
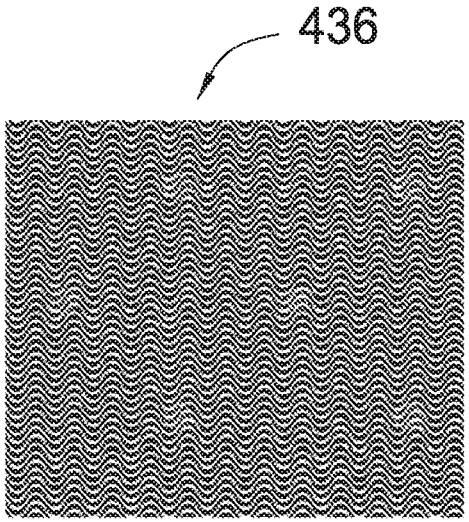
Figure 6C:
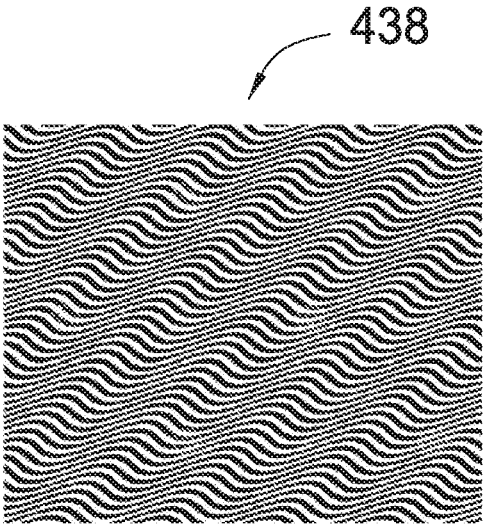

In some embodiments, the curvature may be between about 0.01 and about 2.00, for example, between about 0.10 and about 0.20. As illustrated in FIGS. 4, 5, and 6A, the texture 230/330 may have no nominal variations in the direction of the width 220-W/320-W, while being wavy along the length 220-L/320-L. The texture 230/330 may vary in the direction of the width 220-W/320-W, in addition to or instead of varying along the length 220-L/320-L. For example the surface of gripper profile 225/325 may have an aligned-wave texture 436 as illustrated in FIG. 6B (wherein ridges are light and grooves are dark) or an offset-wave texture 438 as illustrated in FIG. 6C (wherein ridges are light and grooves are dark).

Engaging continuous rod 105 with a gripper assembly 100 may require the less compressive force when the contact surface area between the gripper assembly 100 and the continuous rod 105 is increased. In FIG. 4, the contact surface area will be maximized when continuous rod 105 is round rod having the same radius as the arc of gripper profile 225. In FIG. 5, the contact surface area will be maximized when continuous rod 105 is elliptical rod having the same minor radius as the arc of gripper profile 325. When the radius of the continuous rod 105 is greater than the radius of the arc of gripper profile 225, for example, the contact surface will be two separated surfaces running along the face length 220-L, near the edges of gripper profile 225. Alternatively, when the radius of the continuous rod 105 is less than the radius of the arc of gripper profile 225, the contact surface will be a single surfaces running along the face length 220-L in the middle of gripper profile 225. The contact surface area will decrease as the difference in radii increases. Less contact surface area would necessitate additional compressive force to support the weight of the rod string 120.

Figure 7:
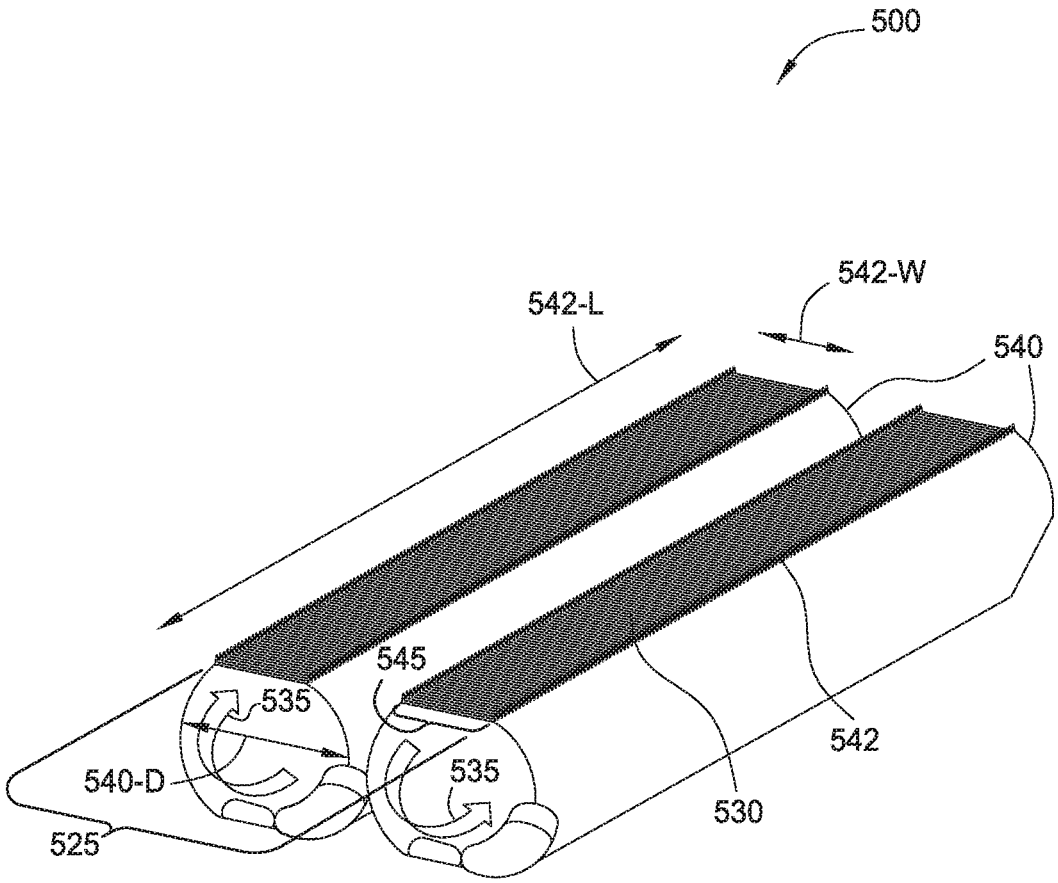
FIG. 7 illustrates a gripper assembly having gripper bars.

In some embodiments, rod injector 111 may be configured to handle each of the expected continuous rod dimensions without user intervention to switch or modify gripper assembly 100. For example, gripper assembly 100 may be configured to passively adapt to a variety of rod shapes and sizes. FIG. 7 illustrates an articulating gripper 500 having a pair of gripper bars 540. Each gripper bar 540 has a diameter 540-D and may rotate 535 about its longitudinal axis independently of the other gripper bar 540. In some embodiments, the diameter of the gripper bar may range from between about ¾ and about 1¼ inch. The gripper bars 540 may be made from a material that resists wear, can be machined with reasonable ease, and will appropriately engage continuous rod 105. For example, gripper bars 540 may be made from a metal, such as steel, carbon steel, and/or 12L14 carbon steel. Each gripper bar 540 has a face 542, which is a concave or planar surface having a length 542-L and a width 542-W. In some embodiments, the width of the gripper bar face may range from between about ¾ and about 1¼ inch. In some embodiments, the length of the gripper bar face may range from between about 1½ inch and about 4 inches. The gripper bar face width 542-W may be between about 40% and about 60% of the diameter 540-D of the respective gripper bar 540. As illustrated, a gripper bar profile 545 is a concave surface on the face 542 of a gripper bar 540. In some embodiments, gripper bar profile 545 may be a flat surface or a concave surface formed (e.g., ground, cut, machined, molded, or 3D printed) into the face 542 of a gripper bar 540. In some embodiments, the radius of curvature of the gripper bar face may range from between about 2 inches and about 2½ inches. Taken together and distributed and oriented spatially, the gripper bar profiles 545 make up the gripper profile 525. As illustrated, gripper profile 525 is a pair of flat surfaces, having lengths in the direction of gripper bar length 542-L. The rotations 535 of the gripper bars 540 may orient the gripper bar profiles 545. When the rotations 535 are both inward, the gripper bar profiles 545 may form two opposing diagonal surfaces. The gripper profile 525 would thereby have a cross-sectional shape like a "V" or a portion thereof. Likewise, the gripper profile 525 would be a concave surface formed in the gripper face 520. The surface of each gripper bar profile 545 has a texture 530. Texture 530 may be configured similar to textures 230/330. The texture 530 of one gripper bar profile 545 may or may not match that of the other gripper bar profile 545.

In the FIG. 7, the two gripper bars 540 have the same diameter 540-D, face width 542-W, and face length 542-L. In some embodiments, an articulating gripper 500 may have gripper bars 540 with different diameters 540-D, face widths 542-W, and/or face lengths 542-L. In some embodiments, an articulating gripper 500 may have more than two gripper bars 540. For example, three gripper bars 540 may be used, wherein the central gripper bar 540 has a smaller diameter 540-D than the outer gripper bars 540. In some embodiments, a ridge may be formed between gripper bars, the face of the ridge having a similar texture as on the face of the gripper bars. Operational requirements may dictate variations in the number and dimensions of gripper bars 540 used in an articulating gripper 500. The gripper bars 540 of articulating gripper 500 may work in conjunction to passively adapt to a variety of rod shapes and sizes.

Figure 8A:
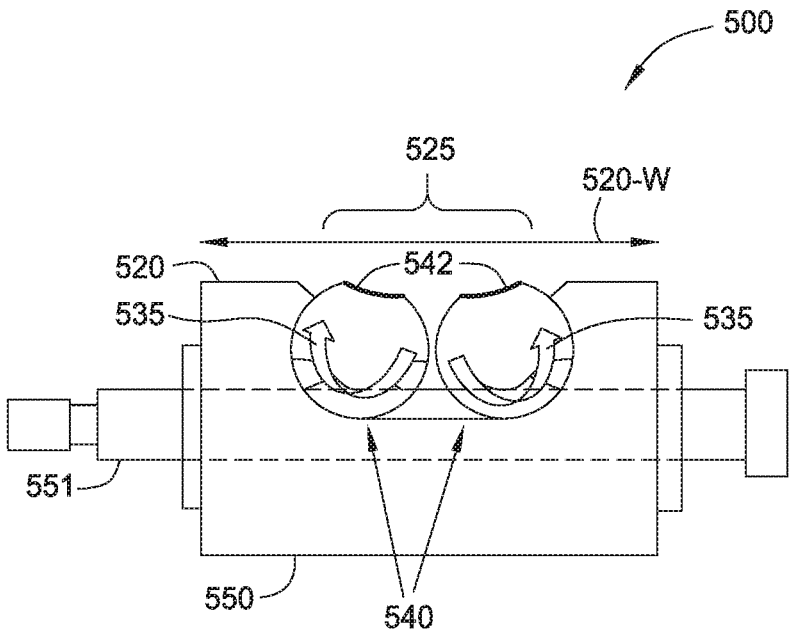
FIGS. 8A and 8B further illustrate the gripper assembly of FIG. 7.
Figure 8B:
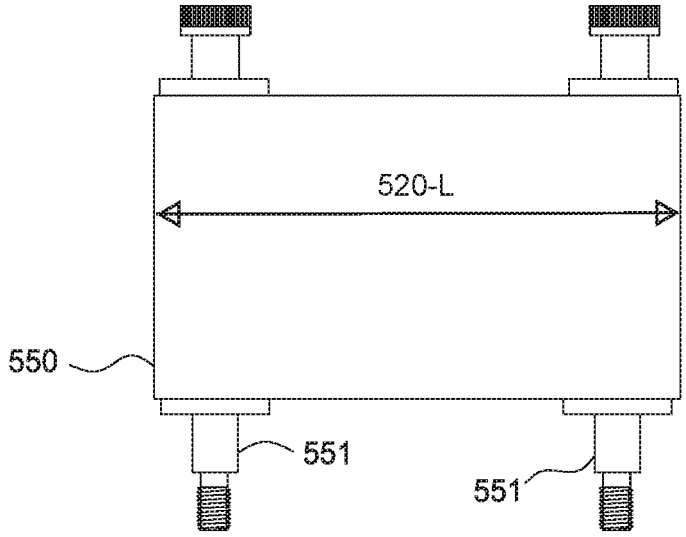
Figure 9A:
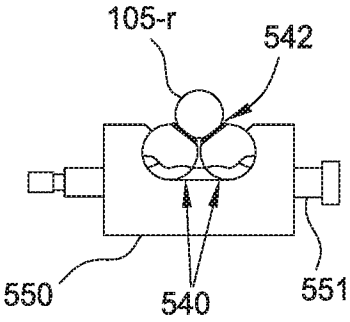
Figure 9B:
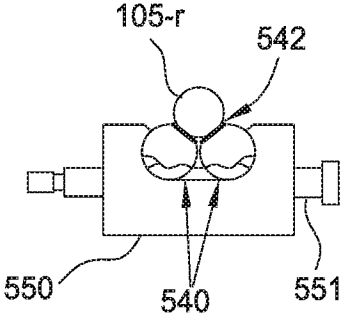
Figure 9C:
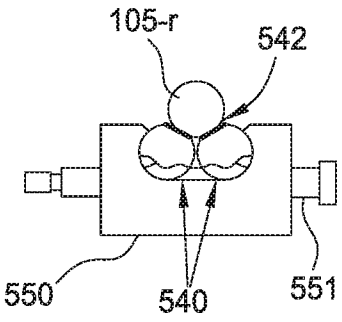
Figure 9D:
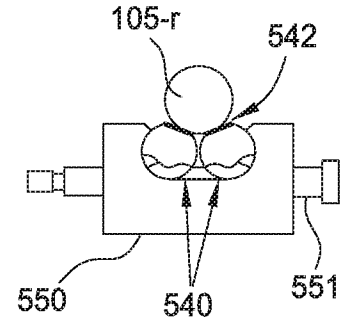
Figure 9E:
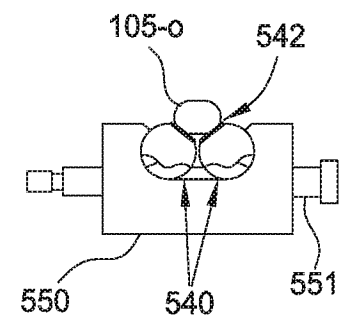
Figure 9F:
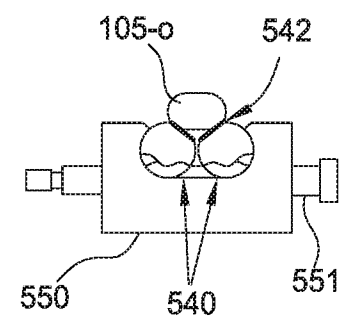

FIGS. 8A and 8B further illustrate articulating gripper 500. The two gripper bars 540 from FIG. 7 are contained in a housing 550. The view in FIG. 8A shows that articulating gripper 500 has a gripper face 520, which is a planar surface spanning housing 550 and gripper bars 540, and having a length 520-L and a width 520-W. In the illustrated embodiment, gripper face length 520-L equals gripper bar face length 542-L. In other embodiments, gripper face length 520-L may be longer than gripper bar face length 542-L. In some embodiments, the face length 520-L may be between about 2 inches and about 4 inches. In some embodiments, the face width 520-W may be between about 1 inch and about 2 inches. The gripper profile 525 is exposed from the gripper bar housing 550 to be accessible for engaging continuous rod 105. Housing 550 may "contain" gripper bars 540 by at least partially surrounding the gripper bars 540 sufficiently to constrain spatial movement, thereby providing compressive force when continuous rod 105 is engaged. Gripper bars 540 are free to rotate 535 within housing 550. Fastener 551 (e.g., a bolt) engages with a bore in housing 550 and contours on gripper bars 540 to secure the gripper bars 540 in the housing 550, while still allowing the gripper bars 540 to rotate 535. In some embodiments, the rotation 535 may be limited to between about 0° and about 75° from the position wherein the gripper bar face 542 is parallel to the gripper face 520. Articulating gripper 500 may attach to gripper assembly 100 with a coupling. For example, in some embodiments, articulating gripper 500 may coupled the gripper assembly 100 to the chains of a rod injector 111 with fastener(s) 551. In some embodiments, gripper housing 550 may be installed between two roller chains of a rod injector 111. Fastener(s) 551 may also function as pins of the roller chain.

FIGS. 9 A-K illustrate how the gripper bars 540 of articulating gripper 500 may work in conjunction to passively adapt to a variety of rod shapes and sizes. Each of the rod dimensions from Table 1 are illustrated:

TABLE 2

| FIG. No. | COROD ® No. |
|---|---|
| 9K | 8 |
| 9J | 7 |
| 9I | 6 |
| 9H | 5 |
| 9G | 4 |
| 9F | 3 |
| 9E | 2 |
| 9D | 8.5R |
| 9C | 6R |
| 9B | 4R |
| 9A | 3R |

The orientation of gripper bar face 542 may be seen to change as the gripper bars 540 rotate 535 when continuous rod 105 is engaged. The contact surface area in each instance includes the majority of the surface area of the gripper bar faces 542. The gripper profile 525, made up of the gripper bar profiles 545, provides an advantageous contact surface area in each instance. The articulating gripper 500 thereby passively adapts to the various rod shapes and sizes.

In an embodiment a gripper assembly for handling continuous rod includes: a gripper face having a face width and a face length; a gripper profile forming a surface in the gripper face; and a texture on a portion of the surface, wherein the texture has a plurality of ridges; the ridges have a curvature of between about 0.5 and 1.5; and the texture has a depth of between about 0.010 inch and about 0.020 inch.

In one or more embodiments disclosed herein, the ridges of the texture have a yield strength sufficient to transfer a shear force to the gripper assembly at least as large as a weight of the continuous rod.

In one or more embodiments disclosed herein, the yield strength of the ridges is between about 60 kilopound per square inch and about 85 kilopound per square inch.

In one or more embodiments disclosed herein, the texture is formed from a material having a high compressive strength.

In one or more embodiments disclosed herein, the material comprises at least one of castable steel and high strength cast iron.

In one or more embodiments disclosed herein, the surface is a concave surface.

In one or more embodiments disclosed herein, the texture is a repeating pattern.

In one or more embodiments disclosed herein, the repeating pattern repeats along a direction of the face length.

In one or more embodiments disclosed herein, the repeating pattern repeats along the entire face length.

In one or more embodiments disclosed herein, the repeating pattern is a sine wave.

In one or more embodiments disclosed herein, a wavelength of the sine wave is less than about 10% of the face length.

In one or more embodiments disclosed herein, the repeating pattern repeats along a direction of the face width.

In one or more embodiments disclosed herein, the gripper assembly also includes a gripper pad, wherein the gripper profile is formed in the gripper pad.

In one or more embodiments disclosed herein, the gripper profile is an arc having a radius less than or equal to ½ of the face width.

In one or more embodiments disclosed herein, the gripper profile spans the entire gripper face.

In one or more embodiments disclosed herein, the gripper assembly also includes a plurality of gripper bars, each having a gripper bar profile, wherein the gripper profile is made up of the gripper bar profiles.

In one or more embodiments disclosed herein, each gripper bar rotates independently of the other gripper bars.

In one or more embodiments disclosed herein, the gripper assembly also includes a housing containing the gripper bars, wherein each gripper bar rotates independently of the housing.

In one or more embodiments disclosed herein, each gripper bar has a gripper bar face having a gripper bar face width and a gripper bar face length.

In one or more embodiments disclosed herein, at least one gripper bar face length is about the same as the face length.

In one or more embodiments disclosed herein, at least one gripper bar face width is between about 5% and about 35% of the face width.

In one or more embodiments disclosed herein, the plurality of gripper bars comprises two gripper bars; and each gripper bar face width is between about 40% and about 60% of a diameter of the respective gripper bar.

In one or more embodiments disclosed herein, at least one of the gripper bar profiles is a concave surface.

In one or more embodiments disclosed herein, a rod injector includes a plurality of the gripper assemblies.

In one or more embodiments disclosed herein, the plurality of gripper assemblies comprises at least two gripper assemblies; and the surfaces of the at least two gripper assemblies face one another.

In an embodiment, a method of handling a rod string includes engaging a rod of the rod string with a contact surface, the contact surface having a texture; penetrating an exterior layer of the rod with a plurality of ridges of the texture; and supporting at least a portion of a weight of the rod string with a shear force in the exterior layer of the rod.

In one or more embodiments disclosed herein, the texture comprises a repeating pattern.

In one or more embodiments disclosed herein, the repeating pattern comprises sine waves.

In one or more embodiments disclosed herein, the exterior layer comprises a protective coating.

In one or more embodiments disclosed herein, the protective coating comprises a fusion bond epoxy.

In one or more embodiments disclosed herein, the contact surface comprises a concave surface formed in a face of a gripper pad.

In one or more embodiments disclosed herein, the contact surface comprises a plurality of gripper bar faces.

In one or more embodiments disclosed herein, engaging the rod of the rod string with the contact surface comprises rotating a plurality of gripper bars to orient the gripper bar faces.

In one or more embodiments disclosed herein, the method also includes changing at least one of a shape of the rod or a dimension of the rod; and adapting the contact surface to the changed shape or dimension.

In one or more embodiments disclosed herein, the method also includes injecting the rod string into a wellbore.

In an embodiment, a gripper assembly for handling continuous rod includes a gripper face having a face width and a face length; a gripper profile forming a surface in the gripper face; and a plurality of gripper bars, each having a gripper bar profile, wherein the gripper profile is made up of the gripper bar profiles.

In one or more embodiments disclosed herein, each gripper bar rotates independently of the other gripper bars.

In one or more embodiments disclosed herein, the gripper assembly also includes a housing containing the gripper bars, wherein each gripper bar rotates independently of the housing.

In one or more embodiments disclosed herein, each gripper bar has a gripper bar face having a gripper bar face width and a gripper bar face length.

In one or more embodiments disclosed herein, at least one gripper bar face length is about the same as the face length.

In one or more embodiments disclosed herein, at least one gripper bar face width is between about 5% and about 35% of the face width.

In one or more embodiments disclosed herein, the plurality of gripper bars comprises two gripper bars; and each gripper bar face width is between about 40% and about 60% of a diameter of the respective gripper bar.

In one or more embodiments disclosed herein, at least one of the gripper bar profiles is a concave surface.

In one or more embodiments disclosed herein, a rod injector includes a plurality of the gripper assemblies.

In one or more embodiments disclosed herein, the plurality of gripper assemblies comprises at least two gripper assemblies; and the surfaces of the at least two gripper assemblies face one another.

In one or more embodiments disclosed herein, a method of handling a rod string includes supporting at least a portion of a weight of the rod string with a plurality of the gripper assemblies.

While the foregoing is directed to embodiments of the present disclosure, other and further embodiments of the disclosure may be devised without departing from the basic scope thereof, and the scope thereof is determined by the claims that follow.

The invention claimed is:

1. A gripper assembly for handling continuous rod, comprising:

a housing; and a plurality of gripper bars rotatably disposed in the housing, each gripper bar having a gripper face defining a gripper bar profile, the gripper bar profiles collectively defining a gripper profile, wherein:

rotation of at least one of the plurality of gripper bars about an axis perpendicular to an axis of rotation of the gripper assembly changes the collectively defined gripper profile.

2. The gripper assembly of claim 1, wherein each gripper bar is rotatable independently of the other gripper bars.

3. The gripper assembly of claim 1, wherein:

the plurality of gripper bars comprises two gripper bars; and each gripper bar includes a gripper bar face having a gripper bar face width that is between about 40% and about 60% of a diameter of the respective gripper bar.

4. The gripper assembly of claim 1, wherein at least a portion of a surface of the gripper profile includes a plurality of ridges, each of the plurality of ridges having a curvature of between about 0.5 and 1.5.

5. The gripper assembly of claim 1, wherein at least a portion of a surface of the gripper profile includes a texture having a depth of between about 0.010 inch and about 0.020 inch.

6. The gripper assembly of claim 5, wherein ridges of the texture have a yield strength sufficient to transfer a shear force to the gripper assembly at least as large as a weight of the continuous rod.

7. The gripper assembly of claim 6, wherein the yield strength of the ridges is between about 60 kilopound per square inch and about 85 kilopound per square inch.

8. The gripper assembly of claim 5, wherein the texture is a repeating pattern.

9. The gripper assembly of claim 1, wherein a length of each of the gripper faces is the same as a length of its respective gripper bar.

10. The gripper assembly of claim 1, wherein each gripper bar profile is a flat surface.

11. The gripper assembly of claim 1, wherein each gripper bar profile is a concave surface.

12. The gripper assembly of claim 1, further comprising:

a fastener engaging with a bore in the housing and the gripper bars to secure the gripper bars in the housing.

13. A method of handling a rod string, the method comprising:

rotating at least one gripper bar of a gripper assembly about an axis perpendicular to an axis of rotation of the gripper assembly to change a gripper profile for engaging an outer surface of a rod of the rod string;

engaging the outer surface of the rod with the gripper profile; and supporting at least a portion of a weight of the rod string using the gripper assembly while the gripper profile engages the outer surface of the rod.

14. The method of claim 13, wherein the at least one gripper bar is disposed in a housing.

15. The method of claim 14, wherein the at least one gripper bar out of a plurality of gripper bars is passively rotated relative to the housing.

16. The method of claim 13, wherein at least two gripper bars are rotated.

17. The method of claim 13, wherein each gripper bar rotates independently of the other gripper bars.

18. The method of claim 13, wherein each gripper bar includes a gripper bar face and a length of each of the gripper faces is the same as a length of its respective gripper bar.

19. The method of claim 13, wherein each gripper bar profile is a flat surface.

20. The method of claim 13, wherein each gripper bar profile is a concave surface.

* * * * *